United States Patent [19]

Sturgis

[11] 4,223,205

[45] Sep. 16, 1980

[54] CENTRAL HEATING SYSTEMS FURNACE HAVING A SELF-CONTAINED ELECTRIC STEAM HEATING UNIT

[76] Inventor: Clifford M. Sturgis, 1213 Westmoreland, Colorado Springs, Colo. 80907

[21] Appl. No.: 910,735

[22] Filed: May 30, 1978

[51] Int. Cl.[2] ..... H05B 1/00; F24H 3/08; F24D 13/04

[52] U.S. Cl. ..... 219/365; 126/101; 165/105; 219/341; 237/16

[58] Field of Search ..... 219/341, 365, 326, 271-276; 237/16-18; 165/105; 126/101; 237/7

[56] References Cited

U.S. PATENT DOCUMENTS

| | | | |
|---|---|---|---|
| 1,174,714 | 3/1916 | Harrison et al. | 237/7 |
| 1,241,244 | 9/1917 | Palmer | 219/341 |
| 1,514,453 | 4/1924 | Freeman | 237/16 |
| 1,662,935 | 3/1928 | Odell | 237/7 |
| 1,684,472 | 9/1928 | Cathcart | 219/341 |
| 1,731,624 | 10/1929 | Henry | 219/341 |
| 1,852,252 | 4/1932 | McIntosh | 219/341 X |
| 2,736,790 | 2/1956 | Alexander | 219/341 |
| 3,640,456 | 2/1972 | Sturgis | 237/16 X |
| 3,927,299 | 12/1975 | Sturgis | 219/341 X |

FOREIGN PATENT DOCUMENTS

| | | | |
|---|---|---|---|
| 183642 | 4/1918 | Canada | 219/341 |
| 803722 | 4/1951 | Fed. Rep. of Germany | 165/105 |
| 490683 | 1/1919 | France | 219/341 |
| 741247 | 12/1932 | France | 237/16 |

*Primary Examiner*—A. Bartis

*Attorney, Agent, or Firm*—Fishburn, Gold & Litman

[57] ABSTRACT

A central heating system furnace includes a self-contained closed-system steam heating unit mounted in a housing having a cold air inlet and a hot air outlet. The unit includes a plurality of side-by-side radiators arranged above a boiler unit having an electric heating element immersed in a quantity of vaporizable liquid. Each radiator comprises a plurality of tubular, finned, heat exchange risers arranged in a row and extending between upper and lower manifolds. In order to distribute steam evenly among each of the radiators and to prevent unvaporized liquid from entering the risers thereof, a horizontal steam tube communicating with the boiler unit is positioned between the boiler unit and radiators and supplies steam to each radiator through a separate steam distributing member in the lower manifold thereof, each steam distributing member including a plurality of steam discharge tubes extending upwardly into the lower portion of different risers of the radiator to distribute steam evenly. A condensate return tube communicates each lower manifold with the boiler unit. A blower circulates air to be heated through the housing over the steam heating unit from the air inlet to the air outlet.

6 Claims, 5 Drawing Figures

CENTRAL HEATING SYSTEMS FURNACE HAVING A SELF-CONTAINED ELECTRIC STEAM HEATING UNIT

BACKGROUND OF THE INVENTION

This invention relates to steam heating devices, and more particularly, to a closed-system, steam heating unit and furnace. The present invention is an improvement to the structures in my previously issued U.S. Pat. Nos. 3,927,299 and 3,640,546 for STEAM HEATING UNIT and SELF CONTAINED STEAM HEATING UNIT respectively. In counterdistinction to the last noted patented structures, this invention includes a steam heating unit which is particularly adapted for use in combination with a blower unit and heating duct work to form a furnace for central heating systems. To facilitate the increased heat energy required to perform properly in this application, a steam cylinder is provided to evenly distribute the steam to the radiator unit, and to prevent unvaporized liquid from entering the risers. Further, a single vessel boiler unit having an elongate, immersion type electric loop element is provided to supply sufficient steam to the radiator unit. Unlike my previously patented devices, which, under full load operation attained pressures in the nature of 18 to 20 psig, the present unit operates at a pressure just slightly greater than atmospheric, in the nature of 0–3 psig for safe and efficient operation.

The principal objects of the present invention are: to provide a steam heating unit for central heating furnaces; and to provide such a device having a steam tube for evenly distributing steam to the radiators, and preventing unvaporized liquid from entering the same. Other objects of the invention are to provide such a device having a single vessel boiler with an immersion type electric loop element mounted therein; to provide such a device having a tubular return member connecting each lower manifold with the boiler to return condensed vapors thereto; and to provide such a device wherein the tubular return is inclined downwardly whereby the condensed vapors are transmitted by gravitational forces. Further objects of the invention are to provide such a device which is evacuated to a sub-atmospheric pressure and operates at a pressure substantially equal to that of the atmosphere for economical heating; and to provide such a device having an enlarged upper manifold for effectively condensing spent steam. Further objects are to provide such a device having boiler temperature and pressure sensing mechanisms for safely controlling furnace operations; and to provide such a device which is economical to manufacture, efficient in use, capable of a long operating life, and particularly well adapted for the proposed use.

Other objects and advantages of this invention will become apparent from the following description taken in connection with the accompanying drawings wherein are set forth, by way of illustration and example, certain embodiments of this invention.

The drawings constitute a part of this specification and include exemplary embodiments of the present invention and illustrate various objects and features thereof.

Figure 1:
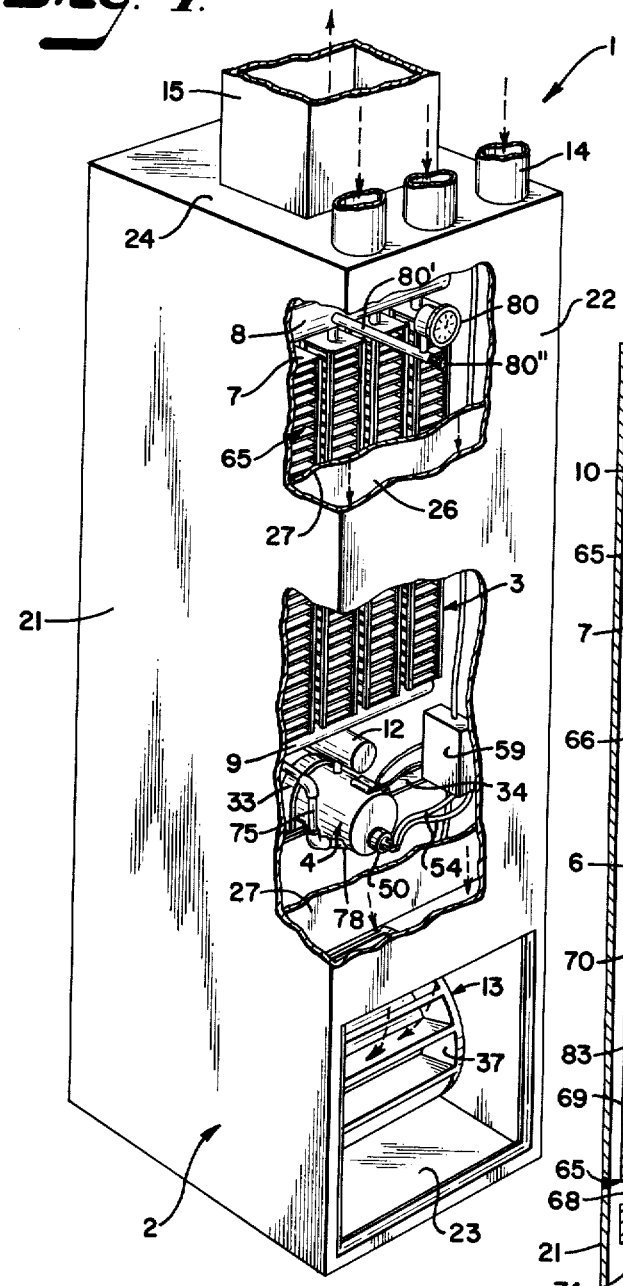
FIG. 1 is a perspective view of a furnace for central heating systems embodying the present invention, and having portions thereof broken away to reveal internal construction.

Referring more in detail to the drawings:

As required, detailed embodiments of the present invention are disclosed herein, however, it is to be understood that the disclosed embodiments are merely exemplary of the invention which may be embodied in various forms. Therefore, specific structural and functional details described herein ae not to be interpreted as limiting, but merely as a basis for the claims and as a representative basis for teaching one skilled in the art to variously employ the present invention in virtually any appropriately detailed structure.

The reference numeral 1 generally designates a furnace for central heating systems embodying the present invention and comprising a housing 2 having a closed-system, steam heating unit 3 mounted therein. The heating unit 3 includes a boiler 4 having a liquid 5 (FIG. 3) disposed therein and being operative to form a vapor from the liquid for flowing the same through orifices 6 into a radiator unit 7. The radiator unit 7 has upper and lower manifolds 8 and 9 respectively, and a plurality of heat exchange risers 10 connected therebetween. A condenser tube 11 communicates the upper manifold 8 and the boiler 4 and returns condensed vapors to the boiler. A steam tube 12 connects the boiler 4 with the lower manifold 9 to evenly distribute the steam to the radiators and to prevent unvaporized liquid from entering the risers 10. A blower mechanism 13 is mounted in the housing 2 and draws air through cold air ducts 14, forces it around the heating unit 3 to receive heat therefrom, and directs the heated air into hot air duct work 15 of the heating system.

The housing 2 supports and encloses the blower 13 and the steam heating unit 3, and forms a heat exchange area between the heated portions of the unit (such as the boiler 4, steam tube 12, and radiator unit 7) and the walls of the housing 2. The illustrated housing 2 has a substantially rectangular shape and includes a pair of side walls 21, end walls 22, and bottom and top panels 23 and 24 respectively. The side and end walls 21 and 22 are preferably constructed of a sheet material such as steel or the like. The steam heating unit 3 is mounted laterally between the housing side walls 21 and is attached thereto in spaced relation with the bottom panel 23. The blower 13 is mounted below the heating unit 3 on the bottom panel 23, and an opening is provided in the lower portion of the outer end wall 22 to provide access to the blower unit 13. A closure panel (not shown) is provided to seal the access opening. Further access openings (not shown) may be provided in the outward end wall 22 to access the steam heating unit 3.

The cold air ducts 14 communicatively connect that portion of the housing 2 which is disposed adjacent to the blower 13 with one or more cold air registers (not shown) dispersed about the central heating system, whereby air is drawn under a slight vacuum by the blower 13 through the cold air duct 14 into the furnace housing 2. A filter unit (not shown) may be mounted in the cold air duct 14 in the path of the air flow to filter foreign particles such as dirt, dust and the like from the air passing through the duct work. In the illustrated structure, a return duct 26 is positioned along the front side of the housing 2, and is formed by a baffle plate 27 having upper and lower edges. The baffle plate 27 is positioned laterally between the side walls 21 and connected therewith, and is spaced inwardly from the front panel 22 a distance substantially coextensive with the diameter of the ducts 14. The upper edge of the baffle plate 27 is connected with the top panel 24, and the lower edge extends slightly below the boiler 4, adjacent the blower 13, thereby forming a passageway to carry cold air from the ducts 14 to the blower. Because the return duct 26 is located adjacent the heat exchange area 20, it functions as a preheating area for the returning cold air.

The hot air duct work 15 communicates the upper portion of the furnace housing 2 or plenum chamber with a plurality of hot air registers (not shown) which are dispersed selectively throughout the heating system. The illustrated hot air duct work 15 is positioned through the top panel 24 of the furnace housing 2 and comprises a vertically oriented, rectangular duct projecting through the top panel 24 to which co-operating members such as elbows and/or tubular line segments (not shown) may be attached.

The steam heating unit 3 is mounted in the upper portion of the furnace housing 2 with the longitudinal axes of the boiler and steam tube members 4 and 12 respectively being oriented in a substantially parallel plane with the side walls 21 and located centrally thereinbetween. In the illustrated structure, band members 33 extend around the marginal surface of the boiler adjacent each end thereof and frictionally engage the same to prevent relative rotation. Each of the bands 33 is attached to a laterally extending bracket member 34 having downwardly bent end portions 35 fastened to opposing furnace housing side walls 21 by suitable fastening means such as bolts 36. The band and bracket members 33 and 34 respectively, securely support the steam heating unit 3 within the housing 2 and position the radiator unit 7 adjacent to and spaced slightly inwardly from the inner surface of the baffle plate 27. Further, the attachment mechanism allows air from the blower 13 to be blown upwardly, over the steam heating unit 3 into the hot air duct 15.

The blower 13 comprises a fan blade 37 rotatably mounted in the lower portion of the housing 2 disposed laterally between side walls 21, and is driven by a direct drive motor (not shown). In the illustrated structure, the fan 37 is a squirrel cage blower adapted for drawing air downwardly through the ducts 14 and 26 and forcing the same upwardly past the radiator unit 7. The motor is preferably electric with direct drive to the fan and is wired through a conventional thermostat device and other suitable switching mechanisms which automatically preheat the steam heating unit prior to activating the blower, and continue blower motion after deactivation of the heating unit until the temperature of the same is lowered to a preselected level. In this example, a temperature sensing device and switch unit 38 is mounted on the boiler side wall adjacent the forward end thereof to selectively activate the blower.

Figure 3:
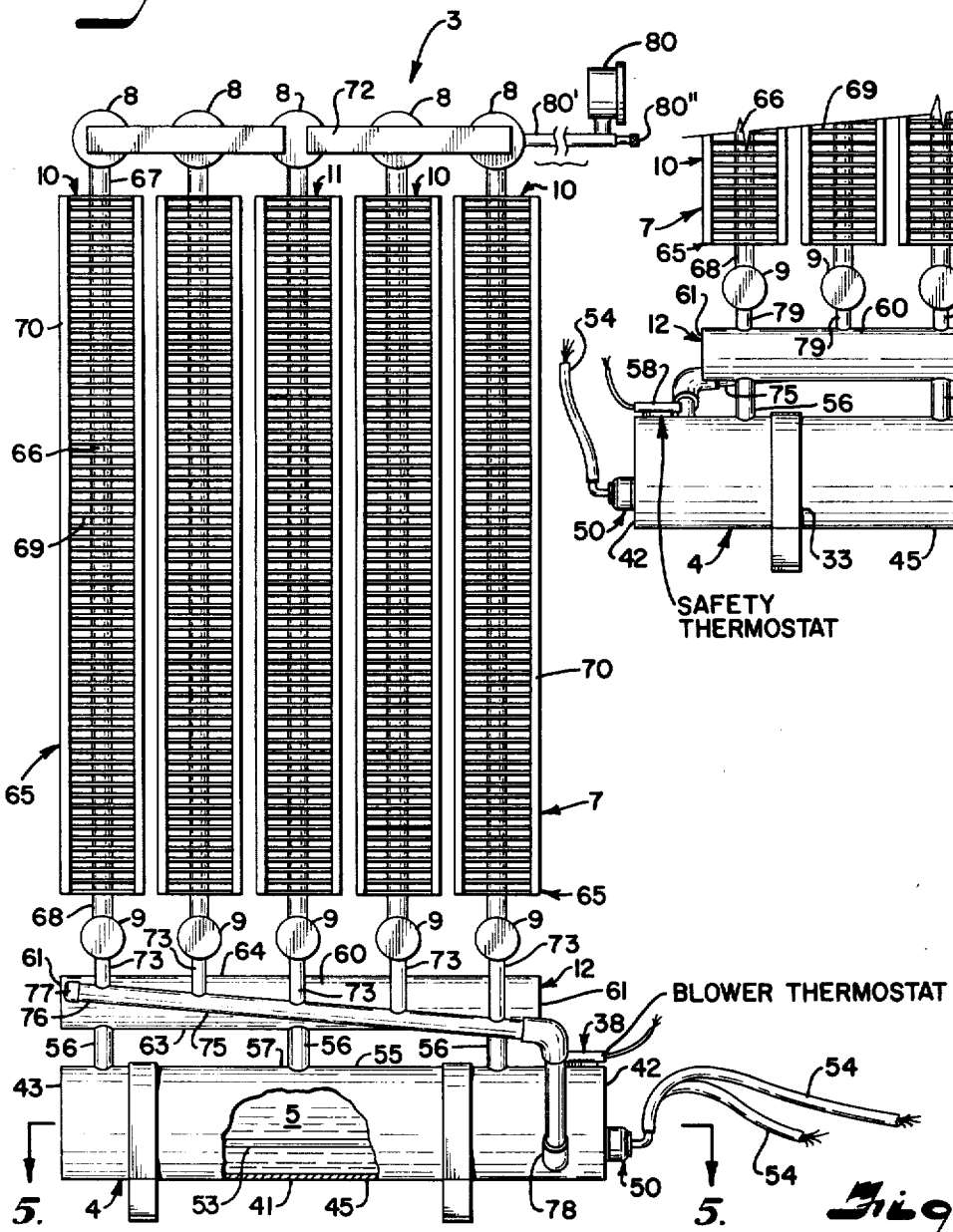
FIG. 3 is a side elevational view of the heating unit taken from one side thereof, with portions broken away.
Figure 4:
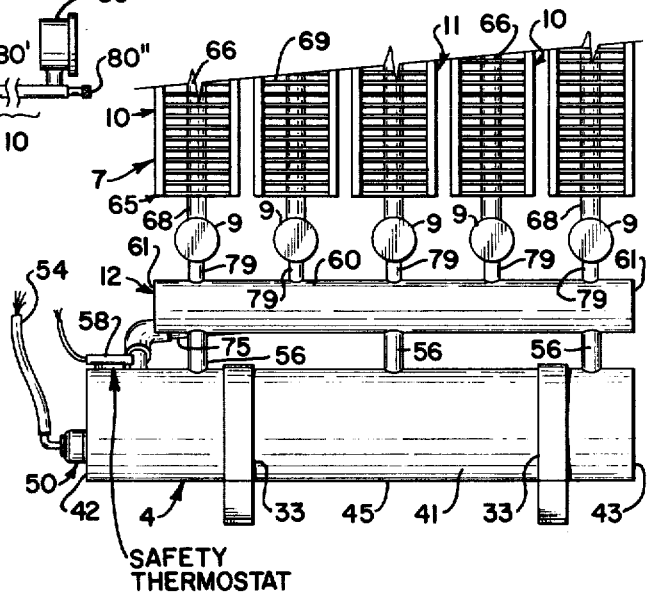
FIG. 4 is a fragmentary side elevational view of the heating unit taken from the other side thereof.
Figure 5:
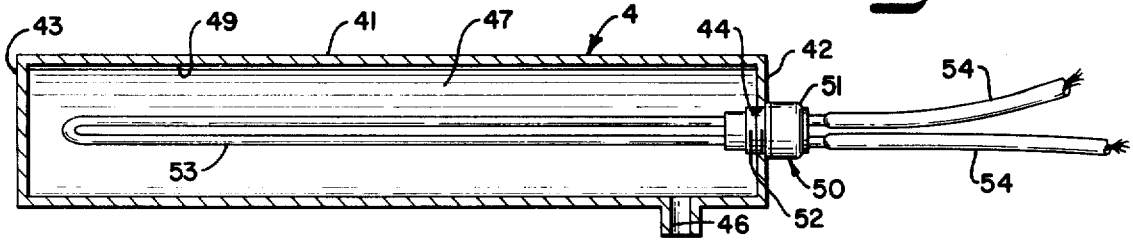
FIG. 5 is an enlarged horizontal cross-sectional view of the heating unit taken along the line 5—5, FIG. 3 and particularly showing a heating element.

The boiler 4 is a single vessel structure adapted to retain and vaporize the liquid 5 therein, and is mounted in the furnace housing 2, above the blower unit 13, and is positioned centrally between and parallel with the housing side walls 21. The illustrated boiler 4 has a substantially, cylindrically shaped side wall 41, with forward and rearward closed ends 42 and 43 respectively (FIGS. 3-5). The forward end 42 of the boiler is provided with a threaded aperture 44 disposed adjacent the lowermost surface 45 of the boiler. A second aperture 46 is positioned through the side wall 41 of the boiler adjacent the forward end 42 and communicates with the boiler cavity 47 near the lower surface 45 thereof. An electric heating element 50 is mounted in the boiler 4 and is adapted to vaporize the liquid 5 contained therein. As best illustrated in FIG. 5, the heating element 50 comprises an insulator cap portion 51 having a threaded plug 52 connected in the boiler aperture 44, and an electrical resistance element 53 which extends longitudinally within the boiler cavity 47 adjacent the lower most internal surface 49 thereof. The illustrated heating element 50 is an elongate, immersion-type electric loop element, which, during operation, is disposed wholly below the free surface of the liquid 5 and is preferably adjacent to the bottom 45 of the boiler. The element 53 preferably has parallel legs which are spaced so as to allow the element to be inserted through aperture 44. Electrical conductors 54 are electrically connected with the element 53 and supply power thereto. The uppermost surface 55 of the boiler is provided with a plurality of radially extending apertures and mating tubular segments 56 sealingly received therein. In this example, three tubular segments 56 are provided, and are aligned along the longitudinal axis of the boiler, and spaced adjacent the rearward end 43, at a medial portion 57, and the forward end 42 thereof respectively. The tubular segments 56 are in communication with the boiler cavity 47 and are preferably disposed in a substantially vertical orientation. The illustrated boiler 4 has a temperature detecting safety device 58 which is constructed similar to the switch 38, is mounted therewith, and is connected with the forward end 42 of the boiler for sensing the temperature of the liquid 5 inside the boiler. The temperature detecting safety device includes suitably switching means operably connected to the main power terminal 59 of the furnace, such that if the temperature of the liquid 5 in the boiler 4 exceeds a predetermined level, power to the boiler element 53 is automatically terminated to prevent over heating.

The steam tube or cylinder 12 is positioned above the boiler 4 in a slightly spaced apart relation thereto and is axially aligned with the boiler, whereby an imaginary plane passing through the geometric centers of each unit is disposed substantially vertically. The steam tube 12 includes a side wall 60 (FIGS. 2 and 3) and closed ends 61 which form a cavity 62 thereinbetween. The lower surface 63 of the steam tube side walls 60 is provided with three spaced apart and aligned apertures for receiving the tubular segments 56 therein and sealingly connecting the boiler with the steam tube and communicating the respective cavities 47 and 62. The uppermost surface 64 of the steam tube has a plurality of generally aligned spaced apart apertures wherein the radiator and condenser units 7 and 11 respectively are mounted.

The radiator unit 7 includes several rows of risers 10, wherein each row includes a plurality of aligned and spaced risers. In this example, five rows 65 of risers 10 are provided, and each row 65 contains five individual risers. It is to be understood, that the number of radiator riser units is selected in accordance with the heating capacity of the unit desired by the user, and may therefore include fewer or more than five rows, and contemplates rows wherein more or less than five individual risers may be mounted. Each of the risers 10 comprises a vertically oriented, heat conductive, tubular member 66 (FIG. 2) having upper and lower ends 67 and 68 respectively and including a plurality of laterally extending, thin plates or fins 69 connected along the length of the tube 66. The fins 69 are constructed of a thermally conductive material such as aluminum, copper, or the like, and in this example, have a substantially square shape with corner guards or braces 70 attached to each corner thereof to protect the fins, and are disposed along a plane substantially perpendicular to the direction of air flow through the furnace 1. In each row of risers 10, the lower ends 68 of the tubes are connected with the lower manifold unit 9, and the tube upper ends are connected with an upper manifold unit 8. In this example, both the upper and lower manifolds have a substantially cylindrical shape with closed ends and are oriented horizontally and as best illustrated in FIG. 3, the ends of the upper manifolds are interconnected by means such as bar members 72 for structural support of the risers. The upper manifolds are enlarged, having a diameter greater than that of the lower manifolds, for improved heat transfer and condensing characteristics. Each of the illustrated lower manifold members includes a tubular member 73 which depends from the lowermost surface of the lower manifold adjacent one end 74 of the manifold. A return tube 75 interconnects the depending tube 73 in each of the riser rows, and includes an upper end 76 which is closed by suitable means such as a cap 77, and a lower end 78 which is sealingly connected in the boiler aperture 46 by a mating fitting. The return tube 75 is inclined downwardly from the upper end 76 to the lower end 78 and transmits condensed vapors from each of the lower manifolds to the boiler under gravitational forces. Each of the lower manifold members 9 also has a short tubular segment 79 connected with and depending from a medial portion thereof. The lower end of each of the tubular segments 79 is sealingly received in an associated and aligned aperture positioned in the top surface 64 of the steam tube 12 and communicatively interconnects the same.

A pressure gauge 80 is connected with the forwardmost one of the upper manifolds 8 and measures the pressure therein for monitoring furnace operation. In this example, the gauge 80 includes an automatic switching device which is electrically connected to the main power terminal 59 and interrupts power flow to the heater elements 53 should the pressure in the steam heating unit exceed a preselected amount in the nature of 10 psig. The illustrated gauge 80 is connected to the manifold 8 by an elongate tube 80' and extends through the duct 26 and front panel 22 for visual reading by the user. The valve 80' is removably connected to the end of the illustrated tube 80', and provides convenient means for creating system vacuum and/or adjusting the system pressure.

Figure 2:
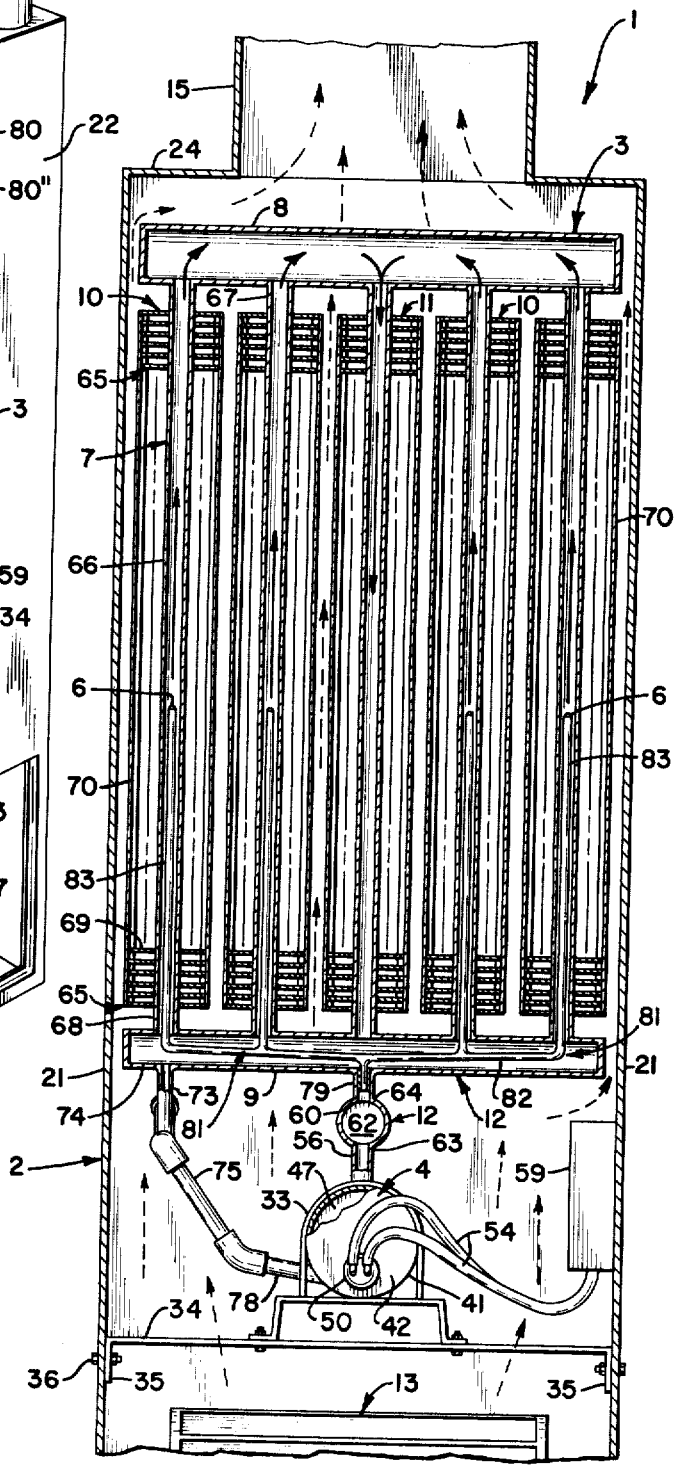
FIG. 2 is a fragmentary vertical cross-sectional view of the furnace particularly showing a steam heating unit therefor.

As best illustrated in FIG. 2, each of the riser rows is provided with a steam dispensing manifold or line arrangement 81 comprising a base member 82 positioned within and extending longitudinally along the lower manifold 9, and upstanding members 83 communicatively connected therewith and extending coaxially within the outermost tubes 66 of the risers 10. The upper end of each upstanding member 83 includes an orifice 6 disposed a spaced apart distance from the lower end of the tube 66 and is adapted for transmitting steam into the associated riser. The length of the upstanding members 83 is preferably selected in accordance with the length of the risers 10, whereby the same may be eliminated in very low profile units. The outermost risers 10 in which the upstanding members 83 are inserted functioned as heat radiators, and the centrally disposed riser which is without an upstanding member therein functions as and defines the condenser 11 for the boiler vapors. Clearance is provided between the outside surface of the upstanding steam dispensing lines 83 and the interior surface of the associated radiator tube 66 to provide a passageway through which vapor condensate may flow under gravitational forces into the lower manifold 9. In the illustrated structure, the manifold base 82 is slightly inclined toward the center to prevent condensation from collecting therein and blocking the flow of steam.

The liquid used in the steam heating unit 3 preferably includes a mixture in the range of approximately 30% water, 70% glycol, and a suitable wetting agent. The glycol is preferably an antifreeze or coolant in the form of ethyleneglycol. The steam heating unit 1 is evacuated during the manufacture thereof to a vacuum in the nature of 17 inches of mercury at 55° F. During full operating conditions, the unit operates at a pressure substantially equal to that of the atmosphere, preferably in the range of 0–3 psig.

In operation, electrical power is supplied to the immersed electrical heating element 50. The temperature of the liquid 5 is thereby raised to its point of boiling or vaporization, and the steam or fluid vapor is emitted, under relative pressure, from the surface of the fluid and expands through the tube segments back into the steam tube 12. The steam tube 12 prevents unvaporized liquid from entering the radiator unit and evenly distributes the vapor to each of the riser rows. From the steam tube 12, the vapor is transmitted through each steam dispensing line arrangement 81 into the associated row of risers. The steam expands upwardly under a pressure differential through each of the discharge orifices 6 thereby imparting heat energy to the tube and fins 66 and 69 respectively, the path of the steam or vapor is shown by arrows in FIG. 2. As the temperature of the vapor is reduced due to the heat exchange with the radiator risers, the vapor is condensed back into the liquid state. Those vapors which condense while rising in the radiator unit form condensate droplets along the side walls of the tube 66 and flow under gravitational forces down the side walls into the lower manifold 9. The liquid is then transmitted through the inclined return tube 75 and introduced to the lower portion of the boiler for reheating and revaporization. Those vapors which are not sufficiently cooled to form condensate by the time they pass through the upper end of the radiator risers enter the upper manifolds 8 and flow therethrough toward the center riser or condenser 11, and thence therethrough downwardly into the lower maifold 9.

When the unit is not operating, the boiler liquid and vapor is under a vacuum. The thermostat (not shown) automatically activates the heating element 50 as room temperature falls below the preselected level. The boiler 4 heats the liquid 5 and circulates the vapors through the unit until such time as the switch 38 is activated indicating that the temperature of the unit is sufficiently high to start the blower 13. Rotation of the blower draws cold air through ducts 14 and 26 into the fan area. The baffle plate 27 is heated due to its proximity to the radiators, and transfers heat to the cold air passing thereover to preheat the same. The preheated air is then forced upwardly through the housing 2 past the boiler 4 and risers 10, thereby imparting heat to the air, the path of the air in the heater housing is shown by broken line arrows in FIGS. 1 and 2. Inasmuch as the unit operates at around zero psig. it is quite safe. Further, it is to be noted that the operating pressure of the unit may be varied in accordance with the flow of air through the housing. Increased air flow past the unit causes reduced operating pressure, and vice versa. Since efficient boiler operation is quite sensitive to the system pressure, it is preferred that the pressure be adjusted in accordance with the altitude and atmospheric conditions where the unit is to be used so as to achieve peak efficiency.

It is to be understood that while I have illustrated and described certain forms of my invention, it is not to be limited to the specific form or arrangement of parts herein described and shown.

I claim:

1. In a self-contained, closed-system steam heating unit having a boiler unit containing a liquid to be vaporized, a heating element operatively associated with said boiler unit to heat said liquid and form vapor in said boiler unit, a plurality of radiators positioned above the boiler unit, said radiators each having a plurality of tubular risers extending therethrough, an upper manifold positioned above the risers and connected thereto and a lower manifold positioned between the risers and the boiler unit and connected to the tubular risers, conduit means connecting the lower manifold of each radiator to a lower portion of the boiler unit for return of condensate thereto, and means for moving air past said radiators, the improvement comprising:

(a) a horizontal steam tube positioned between an upper portion of said boiler unit and said lower manifold and being communicatively connected with the boiler unit for receiving vapor therefrom; and (b) a separate tubular steam distributing member in the lower manifold of each of said radiators, each of said steam distributing members communicating with the upper portion of the steam tube for receiving vapor therefrom, the steam distributing member of each radiator including a plurality of vapor discharge ends, each extending upwardly into a different tubular riser of the radiator for distributing vapor evenly between each of the risers, the arrangement of the steam tube and steam distributing members being such as to distribute the vapor generated in the boiler unit evenly among each of the radiators and prevent unvaporized liquid from entering the risers.

2. A steam heating unit as set forth in claim 1 wherein:

(a) said boiler is elongate and said steam tube is elongate and has a cylindrically shaped side wall longitudinally aligned with said boiler unit, and includes first and second closed ends, and a medial portion; and including (b) first, second and third tube segments providing said communicative connection between said steam tube and said boiler unit; said tube segments each being normally, generally vertically oriented and positioned adjacent the first end, the medial portion and the second end respectively of said steam tube.

3. A steam heating unit as set forth in claim 2 wherein:

(a) said radiators are arranged in parallel, spaced, side-by side arrangement, each radiator including a plurality of aligned tubular risers arranged in a row and interconnected by separate upper and lower manifolds;

(b) each of said rows is oriented perpendicularly to said steam tube; and (c) each of said lower manifolds is attached to an upper portion of said steam tube and said tubular steam distributing members in said lower manifolds includes a steam discharge manifold positioned therein and communicating said steam tube with each tubular riser in the associated row.

4. A steam heating unit as set forth in claim 1 wherein:

(a) said boiler unit comprises an elongate vessel having a lower internal surface thereof retaining said liquid; and (b) said heating element comprises an elongate, immersion type electric loop element positioned in said vessel adjacent to the lower internal surface thereof so as to be immersed in said liquid.

5. A steam heating unit as set forth in claim 1 wherein:

(a) said radiators are adjacently disposed, each radiator including a plurality of aligned tubular risers arranged in a row and interconnected by said lower and upper manifolds;

(b) said conduit means comprises a tubular return member with one end portion thereof having a connection with each lower manifold and the other end portion thereof connected with a lower portion of said boiler unit; said tubular return member communicating each lower manifold and said boiler unit and transmitting condensate from said lower manifolds to said boiler unit; and (c) said tubular return member being inclined in a generally downward direction from said one end portion to the other end portion thereof respectively whereby said condensate is transmitted by gravitational forces.

6. A furnace for central heating system comprising:

(a) a housing;

(b) a closed-system steam heating unit mounted in said housing and including:

(1) a boiler unit containing a liquid to be vaporized therein;

(2) a heating element mounted in said boiler unit and operative to heat the liquid and form steam therein;

(3) a radiator unit positioned above said boiler unit and having a plurality of spaced apart, upright tubular risers, an upper manifold connecting upper ends of the risers and communicating therewith and a lower manifold connecting the lower ends of the risers and communicating therewith;

(4) a horizontal steam tube positioned between an upper portion of said boiler unit and a lower portion of said lower manifold and being communicatively connected with said boiler unit for receiving steam therefrom;

(5) a steam distributing manifold in said lower manifold, said steam distributing manifold having tubular discharge members extending upwardly into lower ends of certain of the risers and having connection with an upper portion of said steam tube for conducting steam therefrom and discharging same upwardly into said risers;

(6) an upright tubular condenser member having upper and lower ends communicating respectively with the upper and lower manifolds in spaced relation to said risers;

(7) a tubular condensate return member with one end portion thereof connected with the lower manifold and, being inclined downwardly therefrom, and having the other end portion thereof connected with a lower portion of said boiler unit for transmitting vapor condensate from said lower manifold to said boiler unit;

(c) a cold air duct connected to said housing and returning cold air from said system to said heating unit;

(d) a hot air duct connected to said housing and receiving warm air from said heating unit and 1 (e) blower means drawing air through said cold air duct and forcing the same around said heating unit to receive heat therefrom, and into said hot air duct.

* * * * *